US008511230B2

(12) United States Patent
Padiolleau et al.

(10) Patent No.: US 8,511,230 B2
(45) Date of Patent: Aug. 20, 2013

(54) SAFETY AND ARMING DEVICE FOR A SPIN-STABILISED EXPLOSIVE PROJECTILE AND A PRIMING DEVICE IMPLEMENTING SUCH A SAFETY AND ARMING DEVICE

(75) Inventors: Bertrand Padiolleau, Saint Florent (FR); Renaud Lafont, Bourges (FR)

(73) Assignee: Nexter Munitions, Versailles (FR)

( * ) Notice: Subject to any disclaimer, the term of this patent is extended or adjusted under 35 U.S.C. 154(b) by 4 days.

(21) Appl. No.: 13/226,062

(22) Filed: Sep. 6, 2011

(65) Prior Publication Data

US 2012/0067241 A1 Mar. 22, 2012

(30) Foreign Application Priority Data

Sep. 22, 2010 (FR) ..... 10 03774

(51) Int. Cl.
*F42C 15/26* (2006.01)

(52) U.S. Cl.
USPC ..... 102/235; 102/231; 102/245; 102/256

(58) Field of Classification Search
USPC ..... 102/222, 231, 235, 237, 244, 245, 102/247, 251, 256
See application file for complete search history.

(56) References Cited

U.S. PATENT DOCUMENTS

| | | | | |
|---|---|---|---|---|
| 4,662,279 | A * | 5/1987 | Popovitch | 102/233 |
| 4,770,096 | A * | 9/1988 | Maruska et al. | 102/229 |
| 4,938,138 | A * | 7/1990 | Maruska | 102/235 |
| 5,067,405 | A * | 11/1991 | Popovitch et al. | 102/232 |
| 5,147,974 | A | 9/1992 | Bai et al. | |
| 7,444,937 | B2 * | 11/2008 | Magnan et al. | 102/254 |
| 7,490,553 | B2 * | 2/2009 | Magnan et al. | 102/254 |
| 8,161,878 | B2 * | 4/2012 | Schellhorn et al. | 102/254 |
| 8,166,880 | B2 * | 5/2012 | Lafont | 102/231 |

FOREIGN PATENT DOCUMENTS

| | | |
|---|---|---|
| FR | 1.184.670 | 7/1959 |
| FR | 2 533 686 A1 | 3/1984 |
| FR | 2 689 972 A1 | 10/1993 |

OTHER PUBLICATIONS

French Preliminary Search Report in French Patent Application No. 1003774; dated May 19, 2011 (with English-language translation).

* cited by examiner

*Primary Examiner* — James Bergin
(74) *Attorney, Agent, or Firm* — Oliff & Berridge, PLC

(57) ABSTRACT

A safety and arming device for a spin-stabilized explosive projectile, said device incorporating a screen obstructing a transmission channel linking a detonator and a pyrotechnic relay, said screen comprising two half-screens able to move with respect to one another and transversally with respect to said channel, said two half-screens obstructing said channel when contacting one another, wherein said two half-screens are able to slide in a bore hole carried by a rotor coaxial to said projectile, said rotor is able to pivot on the axis of said projectile and carries said channel, said two half-screens locked into the position obstructing said channel by at least two locks, a first lock or inertial lock which retracts when said projectile is fired and a second lock or centrifugal lock formed by a spiral spring surrounding an external cylindrical surface of said rotor and applied against the ends of said half-screens.

9 Claims, 3 Drawing Sheets

SAFETY AND ARMING DEVICE FOR A SPIN-STABILISED EXPLOSIVE PROJECTILE AND A PRIMING DEVICE IMPLEMENTING SUCH A SAFETY AND ARMING DEVICE

BACKGROUND OF THE INVENTION

1. Field of the Invention

The technical scope of the invention is that of priming devices (fuses) for spin-stabilized projectiles and in particular that of safety and arming devices equipping such priming devices.

2. Description of the Related Art

Spin-stabilized explosive projectiles, and in particular medium caliber projectiles (caliber of less than 50 mm), more often than not incorporate a safety and arming device that incorporates a rotor for the primer that is released further to the projectile being fired. This rotor has an out-of-balance that ensures the alignment of the primer with the rest of the pyrotechnic priming train.

Patents FR-2689972 and FR-2533686 describe such safety and arming devices. The out-of-balance rotor is put into place in a cage that is free to rotate with respect to the projectile's axis.

One drawback to these known devices lies in that they require a primer (thus a pyrotechnic component) to be put in place on the rotor. The primer must, in addition, be of a relatively small size for medium caliber applications (caliber of less than 50 mm).

Another drawback is that, if this solution is well adapted to projectiles in which the rotor primer is initiated by percussion, it is more difficult to implement for a projectile in which the primer is initiated by an electric current supplied by electronic fire control means. Such functioning modes are employed when projectiles are to be made that use a programmable timer fuse.

It is, in fact, difficult to make flexible conductors that are able to accompany the pivoting of the primer rotor without disturbing the latter's movement.

A safety and arming device is known by patent EP-1780495 that comprises a screen formed by two half-screens that obstruct a transmission channel linking a detonator and a pyrotechnic relay.

These half-screens are mobile via the action of motor means, for example one or several springs, released by electronically-controlled locks.

Such a solution is particularly well adapted to production in the form of micro electro-mechanical integrated circuits. However, to produce screens of larger sizes, the motor means or control locks become difficult to integrate, in particular in a medium-caliber projectile.

SUMMARY OF THE INVENTION

The aim of the invention is to propose a safety and arming device that is easily integrated into a projectile, even one of reduced caliber. This device enables the use of an electrically initiated detonator without its being necessary to install it in a rotor.

The invention thus proposes a safety and arming device that can be housed in the same volume as known rotor devices.

Thus, the invention relates to a safety and arming device for a spin-stabilized explosive projectile, such device incorporating a screen obstructing a transmission channel linking a detonator and a pyrotechnic relay, the screen being constituted by two half-screens able to move with respect to one another and transversally with respect to the transmission channel, the two half-screens obstructing the channel when they are in contact with one another, such device wherein the two half-screens are mounted able to slide in a bore hole carried by a rotor coaxial to the projectile, rotor which is itself mounted able to pivot with respect to the projectile's axis and which carries the transmission channel, the two half-screens being furthermore locked into the position in which they obstruct the channel by at least two locks, a first lock or inertial lock which retracts when the projectile is fired and a second lock or centrifugal lock that is formed by a spiral spring surrounding an external cylindrical surface of the rotor and thus applied against the ends of the half-screens, such spiral unwinding under the effect of the centrifugal force.

Advantageously, the half-screens are made in the form of cylindrical rods which have one end in contact with the spiral in the form of a spherical cap.

The rods forming the half-screens will preferably be in mutual contact by their ends incorporating matching conical machining.

The first lock may be constituted by a ring mounted able to slide with respect to the rotor and incorporating an internal conical seat that presses on the half-screens, the ring incorporating an external groove receiving a circular metallic band pressing on a limit stop integral with the device, such band ensuring the axial immobilization of the ring before the projectile is fired and which is deformed through the effect of the axial acceleration during firing to escape the limit stop and enable the ring to translate.

The metallic band is carried by a circular rim of the ring that is introduced, during the translation of the ring, into a groove in a fixed plate.

The invention also relates to a priming device implementing such a safety and arming device, priming device incorporating an electrically-initiated detonator whose assembly and integration are made easier.

This priming device is characterized in that the detonator is arranged along the projectile's axis and connected to an electronic card of a firing module.

The electronic card may carry a cup at least partially surrounding the detonator, such cup ensuring an electrical contact between the card and the detonator.

BRIEF DESCRIPTION OF THE DRAWINGS

The invention will become more apparent from the following description of a particular embodiment, such description made with reference to the appended drawings, in which.

DETAILED DESCRIPTION OF PREFERRED EMBODIMENTS

Figure 1A:
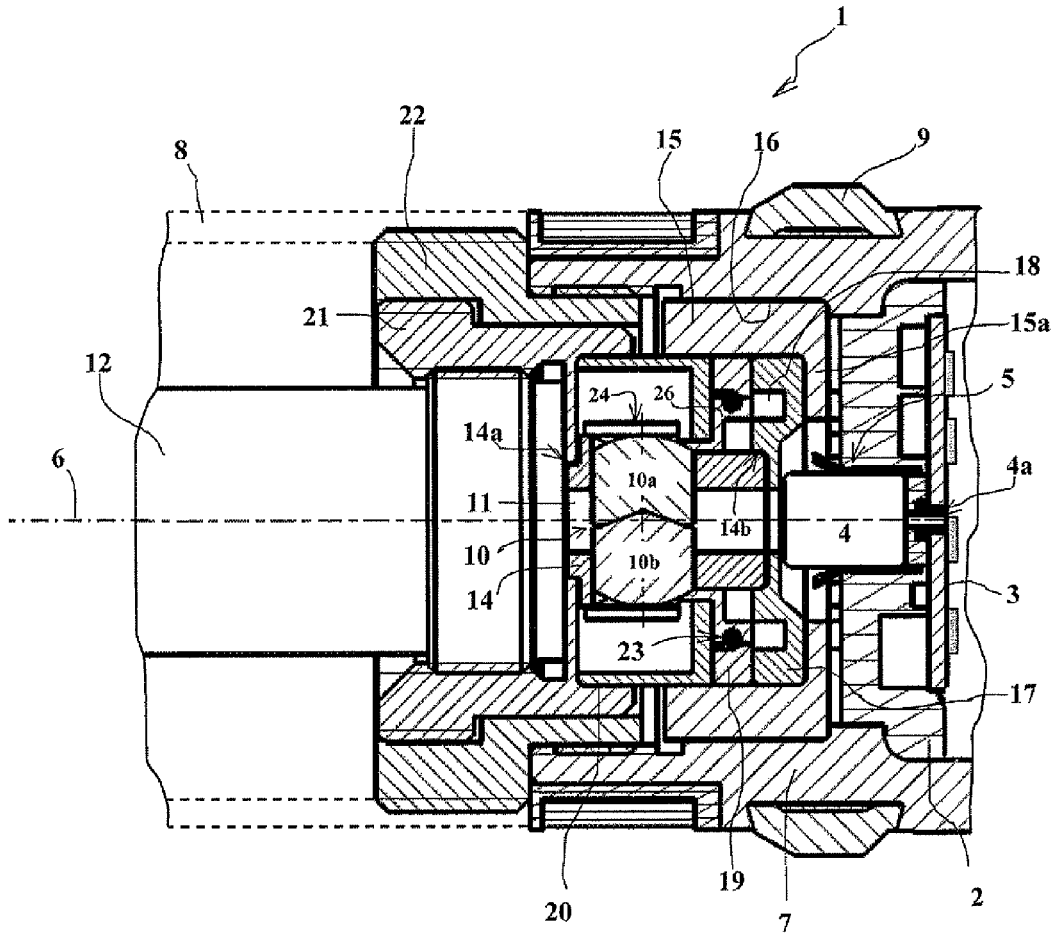
FIG. 1*a* shows a longitudinal section of a priming device for a medium caliber projectile incorporating a safety and arming device according to the invention, the safety device being shown in the safety position.

With reference to FIG. 1, a priming device (fuse) 1 according to the invention incorporates a firing module 2 that incorporates an electronic card 3 on which a detonator 4 is fixed.

The detonator 4 is electrically initiated. It incorporates an axial pin 4*a* that is directly connected to the electronic card 3. Furthermore, the electronic card 3 carries a conductive cup 5

(welded to the card) that surrounds the detonator 4 at least partially and ensures another electrical contact between the card 3 and the detonator 4.

The detonator 4 is thus fixed here, arranged along the axis 6 of the projectile and connected to the electronic card 3 of the firing module 2.

This results in a simplified mechanical module of this pyrotechnic element.

The electronic module 2 is arranged in a base 7 that closes the rear of the projectile and it is fixed to its body 8. The full projectile is not shown in the Figures. Part of its external profile is shown in dashes 8.

The base 7 carries a belt 9 intended to ensure gas-tightness during firing from a gun.

The priming device 1 also incorporates a safety and arming device that incorporates a screen 10 obstructing a transmission channel 11 linking the detonator 4 and a pyrotechnic relay 12. The transmission channel 11 has the same axis 6 as the projectile. The detonation relay 12 is intended to initiate an explosive load (not shown) placed inside the body 8.

The screen 10 is constituted by two half-screens 10*a* and 10*b* that are able to move with respect to one another and transversally with respect to the transmission channel 11. These two half-screens 10*a* and 10*b* obstruct the channel 11 when they are in contact with one another, in the safety position shown in FIG. 1*a*.

Figure 1B:
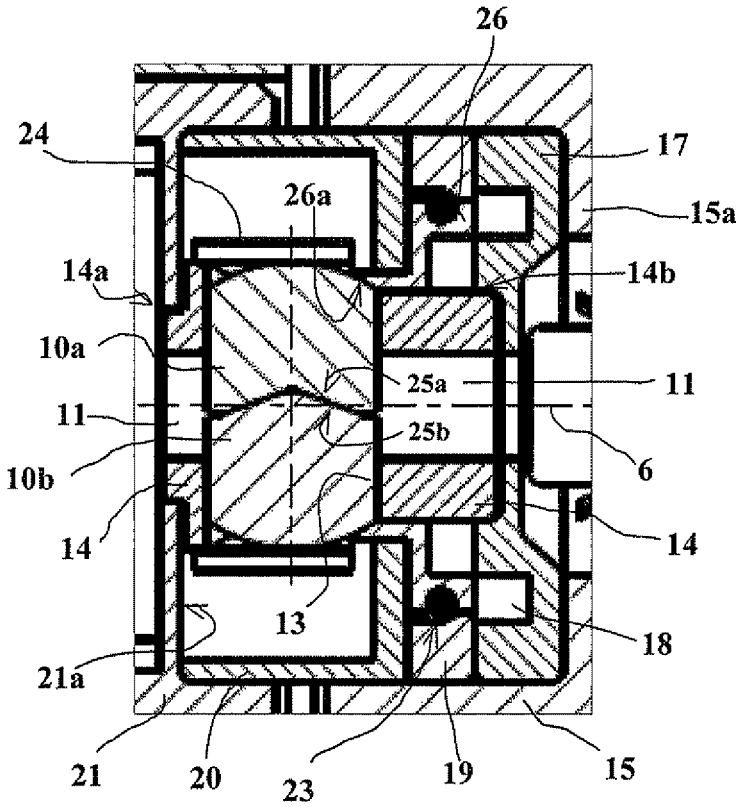
FIG. 1*b* is an enlarged view of part of the device in FIG. 1*a*, FIGS. 2*a*, 2*b* and 2*c* show three successive states for the safety device, FIG. 2*a* showing the device after the first lock has been released, FIG. 2*b* after the release of the second lock and FIG. 2*c* in the armed position.

Each half-screen 10*a* or 10*b* is made in the form of a cylindrical rod mounted able to slide in a cylindrical bore hole 13 arranged in a rotor 14 that is coaxial to the projectile (FIG. 1*b*). The bore hole 13 is perpendicular to the transmission channel 11 which is also drilled in the rotor 14.

The rods 10*a* and 10*b* forming the half-screens are in mutual contact by their ends 25*a* and 25*b* which incorporate conical machining of matching shapes (FIG. 1*b*). Thus, half-screen 10*b* has an end 25*b* that incorporates a male cone, whereas half-screen 10*a* has a female cone at its end. The matching conical shapes facilitate the adaptation of the half-screens during assembly.

Thanks to such an arrangement, the interface between the two half-screens is not a plane and the stoppage of a pyrotechnic effect is ensured as efficiently as if the screen were of one piece.

The rotor 14 is mounted free to rotate with respect to the axis 6 of the projectile and thus with respect to the priming device 1. It thus incorporates cylindrical trunnions 14*a* and 14*b* that are positioned in matching seats integral with the priming device 1.

Note in FIGS. 1*a*, 1*b* that the priming device encloses a casing 15 housed in a bore hole 16 in the base 7 and which has a pierced wall 15*a* surrounding the detonator 4. This casing 15 receives a plate 17 that has a cylindrical seat to receive the rear trunnions 14*b* of the rotor 14. The plate 17 also incorporates a circular groove 18 and has the same axis 6 as that of the projectile, groove whose purpose will be described hereafter.

The bore hole 16 of the base 7 also houses a washer 19 and a spacer cage 20 applied against the washer 19 by a rear threaded plug 21 that closes the safety and arming device.

The threaded plug 21 incorporates a wall 21*a* (FIG. 1*b*) that has a cylindrical seat to receive the front trunnions 14*a* of the rotor 14.

The threaded plug 21 is screwed in a connecting ring 22, itself screwed to the device's base 7.

Note in FIGS. 1*a* and 1*b* that screwing the plug 21 enables different parts of the safety and arming device to be axially linked to the base 7, namely: the spacer 20, the washer 19, the plate 17 and the rotor 14.

Note in FIGS. 1*a* and 1*b* the presence of a ring 26 between the spacer 20 and the plate 17. This ring 26 forms a first lock (or inertial lock) ensuring that the two half-screens 10*a* and 10*b* are held locked in the position in which they obstruct the channel 11.

The ring 26 is mounted able to slide with respect to the rotor 14 and it incorporates an internal conical seat 26*a* which (in the locked position of the device) presses against the two half-screens 10*a* and 10*b* locking them into the safety position (obstruction of the channel).

The ring 26 also incorporates an external groove that receives a circular metallic band 23. In the locked position (FIGS. 1*a*, 1*b*) of the device, this band 23 presses on a limit stop formed by a conical surface on the washer 19.

The external groove of the ring 26 carrying the band 23 is made in a circular rim of the ring whose thickness is less than the width of the groove 18. Thus, when the device is unlocked, the ring 26 can be introduced into the groove 18 in the plate 17.

Lastly, the safety and arming device incorporates a second lock (or centrifugal lock) that is constituted by a spiral spring 24 that surrounds the external cylindrical surface of the rotor 14. This spiral is thus pressed against the ends of the half-screens 10*a* and 10*b*.

Such a spiral spring is already known, namely by patents FR-2689972 and FR-2533686. It unwinds progressively further to the centrifugal force due to the projectile's spin. This is made possible because of the rotor's freedom to spin with respect to the rest of the device 1. It leads to a spin differential between the rotor 14 and the device body 1.

Thus, when the projectile is made to spin, an external end of the spiral will move away from the rotor 14 to press against the internal cylindrical surface of the spacer 20. The spiral will gradually unwind introducing a spin differential between the rotor 14 and the spacer 20 and will end up by completely disengaging from the rotor 14 to be pressed fully against the spacer 20.

Note in FIGS. 1*a* and 1*b* that each rod 10*a* and 10*b* has an end in contact with the spiral 24 that is in the form of a spherical cap (of a radius equal to that of the rotor). Such an arrangement enables a linear (circular) contact between the rods 10*a*, 10*b* and the spiral 24. Any marking of the spiral spring 24 is thereby avoided.

The functioning of the safety and arming device will now be described with reference to FIGS. 2*a* to 2*c*.

Figure 2A:
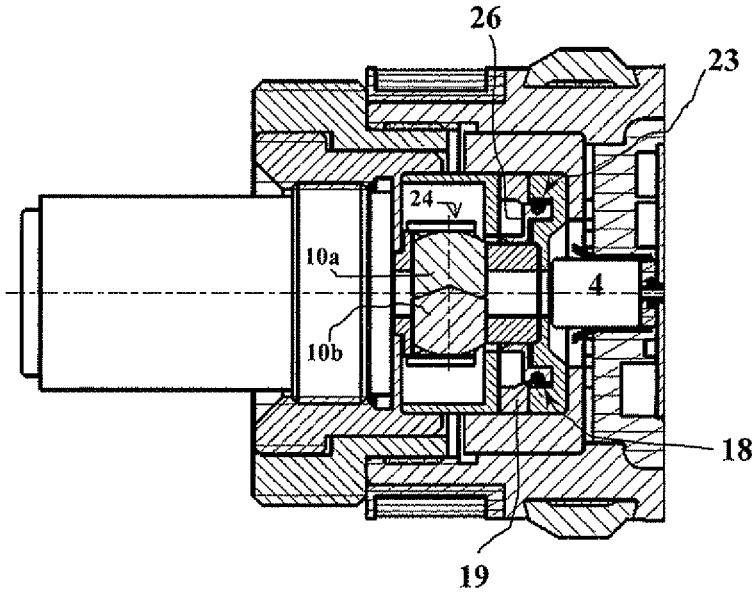

FIG. 2*a* shows the state of the device upon firing. The axial acceleration received by the projectile has caused the ring 26 to recoil, thereby causing a deformation of the band 23 which escapes from its limit surface on the washer 19. The ring 26 translates and its circular rim is introduced in the groove 18 in the plate 17.

The internal conical seat 26*a* in the ring 26 is thus no longer pressing against the half-screens 10*a* and 10*b*. The ring 26 is thus no longer locking the half-screens, but remains immobilized in the safety position, however, by the spiral 24.

The band 23 also engages in groove 18 and ensures the immobilization of the ring 26 in its unlocked position (FIG. 2*a*).

Figure 2B:
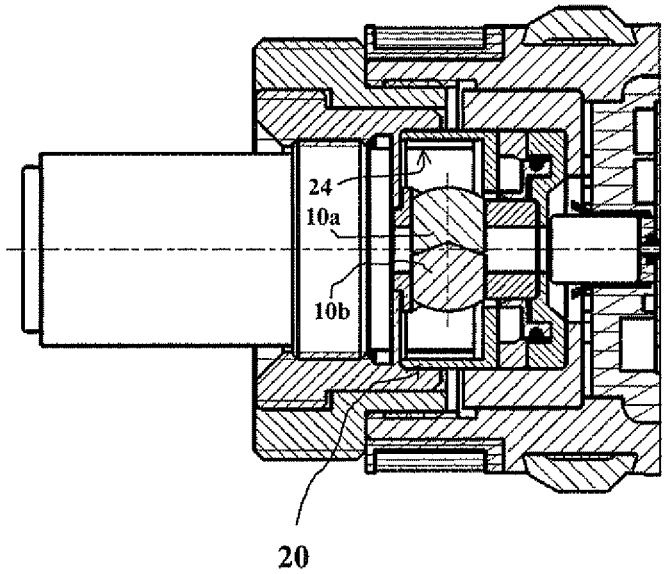

FIG. 2*b* shows the device after its exiting the gun barrel and once it has covered a safety distance from the muzzle of around a few tens of meters.

The projectile's spin has caused the spiral 24 to fully unwind until it presses on the inner surface of the spacer 20. The second lock of the half-screens 10*a* and 10*b* is thus released.

Figure 2C:
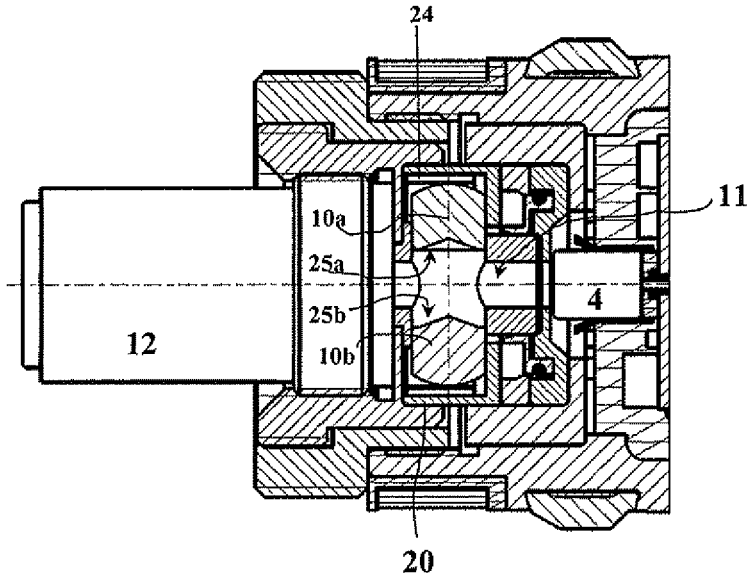

This state is momentary since the half-screens 10*a* and 10*b*, driven by the centrifugal force, move away from one another and press against the spiral 24 thereby fully releasing the axial transmission channel 11 (FIG. 2*c*).

The device is thus now in the armed state and the detonator 4 is able to initiate the relay 12 at the required time programmed before firing.

What is claimed is:

1. A safety and arming device for a spin-stabilized explosive projectile, said device comprising:

a screen obstructing a transmission channel linking a detonator and a pyrotechnic relay, said screen being constituted by two half-screens able to move with respect to one another and transversally with respect to said transmission channel, said two half-screens having ends and obstructing said channel when the two half-screens are in contact with one another, wherein said two half-screens are configured to slide in a bore hole, which is perpendicular to the transmission channel and is carried by a rotor coaxial to said projectile, said rotor is configured to pivot with respect to a longitudinal axis of said projectile and carry said transmission channel, said two half-screens are locked into a position in which the two half-screens obstruct said transmission channel by at least two locks, a first lock or inertial lock which retracts when said projectile is fired and a second lock or centrifugal lock that is formed by a spiral spring surrounding an external cylindrical surface of said rotor and thus applied against the ends of said two half-screens, said spiral spring unwinding under an effect of a centrifugal force and allowing the two half-screens to move to a position in which the two half-screens do not obstruct the transmission channel.

2. The safety and arming device according to claim 1, wherein said two half-screens are formed as cylindrical rods which have one end in contact with said spiral spring which is formed as a spherical cap.

3. The safety and arming device according to claim 2, wherein said cylindrical rods forming said two half-screens are in mutual contact by their ends incorporating matching conical machining.

4. The safety and arming device according to claim 3, wherein said first lock is constituted by a ring that is configured to slide with respect to said rotor and incorporate an internal conical seat that presses on said two half-screens, said ring incorporates an external groove receiving a circular metallic band pressing on a limit stop integral with said device, said band ensures an axial immobilization of said ring before said projectile is fired and which is deformed through an effect of an axial acceleration during firing to escape said limit stop and enable said ring to translate.

5. The safety and arming device according to claim 2, wherein said first lock is constituted by a ring that is configured to slide with respect to said rotor and incorporate an internal conical seat that presses on said two half-screens, said ring incorporates an external groove receiving a circular metallic band pressing on a limit stop integral with said device, said band ensures an axial immobilization of said ring before said projectile is fired and which is deformed through an effect of an axial acceleration during firing to escape said limit stop and enable said ring to translate.

6. The safety and arming device according to claim 1, wherein said first lock is constituted by a ring that is configured to slide with respect to said rotor and incorporates an internal conical seat that presses on said two half-screens, said ring incorporates an external groove receiving a circular metallic band pressing on a limit stop integral with said device, said band ensures an axial immobilization of said ring before said projectile is fired and which is deformed through an effect of an axial acceleration during firing to escape said limit stop and enable said ring to translate.

7. The safety and arming device according to claim 6, wherein said metallic band is carried by a circular rim of said ring that is introduced, during the translation of said ring, into a groove in a fixed plate.

8. A priming device implementing said a safety and arming device according to claim 1, wherein said detonator is arranged along said longitudinal axis of said projectile and is connected to an electronic card of a firing module.

9. The priming device according to claim 8, wherein said electronic card carries a cup at least partially surrounding said detonator, said cup ensuring an electrical contact between said card and said detonator.

* * * * *